US011490716B2

(12) United States Patent
Salisbury

(10) Patent No.: US 11,490,716 B2
(45) Date of Patent: Nov. 8, 2022

(54) LOAD-RATED TOOL TETHER

(71) Applicant: Gripps Global Pty Ltd, Tullamarine (AU)

(72) Inventor: David Salisbury, Tullamarine (AU)

(73) Assignee: GRIPPS GLOBAL PTY LTD, Tullamarine (AU)

( * ) Notice: Subject to any disclaimer, the term of this patent is extended or adjusted under 35 U.S.C. 154(b) by 23 days.

(21) Appl. No.: 16/975,032

(22) PCT Filed: Mar. 8, 2019

(86) PCT No.: PCT/AU2019/050205
§ 371 (c)(1),
(2) Date: Aug. 21, 2020

(87) PCT Pub. No.: WO2019/169449
PCT Pub. Date: Sep. 12, 2019

(65) Prior Publication Data

US 2020/0390224 A1 Dec. 17, 2020

(30) Foreign Application Priority Data

Mar. 8, 2018 (AU) ..... 2018900747

(51) Int. Cl.
*B65D 63/00* (2006.01)
*A45F 5/00* (2006.01)
(Continued)

(52) U.S. Cl.
CPC ..... *A45F 5/00* (2013.01); *B65D 63/1072* (2013.01); *A45F 2005/006* (2013.01);
(Continued)

(58) Field of Classification Search
CPC .... B65D 63/00; B65D 63/1072; B65D 63/18; A45F 2005/006; A45F 2200/0575; F16B 2/005
See application file for complete search history.

(56) References Cited

U.S. PATENT DOCUMENTS 2,977,145 A * 3/1961 Rifkin ..... B65D 63/1063 292/321
4,558,495 A * 12/1985 Olsen ..... B23B 45/006 24/16 PB
(Continued)

FOREIGN PATENT DOCUMENTS

GB 2447489 A 9/2008
JP 2017136238 A 8/2017

OTHER PUBLICATIONS

International Search Report dated May 16, 2019 from PCT Application No. PCT/AU2019/050205.

*Primary Examiner* — Adam J Waggenspack
(74) *Attorney, Agent, or Firm* — Innovation Capital Law Group, LLP; Vic Lin

(57) ABSTRACT

A load-rated tool tether has a gate and a serrated surface strap integrally formed with the gate and extending from the gate. The gate has a channel therethrough between an entrance and an exit and a locking tang operably interfacing the channel between the entrance and the exit for the feed in and one-way non-releasable engagement of the strap therethrough in use. The tether has a securement ring integrally formed with the gate and extending from between the entrance and the connection edge of the gate at an angle with respect to the longitudinal axis of the channel. When the strap is tightened around a tool, the securement ring is resiliency held by the integrally formed gate secured either side thereof by the strap between the integral connection
(Continued)

edge and the entrance in a spaced apart configuration and the undersurface bears tangentially against the tool.

2 Claims, 6 Drawing Sheets

(51) Int. Cl.
*B65D 63/10* (2006.01)
*B25B 23/00* (2006.01)
*B65D 63/18* (2006.01)

(52) U.S. Cl.
CPC ..... *A45F 2200/0575* (2013.01); *B25B 23/00* (2013.01); *B65D 63/18* (2013.01)

(56) References Cited

U.S. PATENT DOCUMENTS 4,958,414 A * 9/1990 Benoit ..... B65D 63/1063 24/16 PB
5,082,156 A 1/1992 Braun
5,711,055 A * 1/1998 Quick ..... B25F 5/00 24/129 R
6,655,560 B2 * 12/2003 Kahn ..... A45F 5/02 224/197
6,751,828 B2 * 6/2004 Matschiner ..... B65D 63/1072 24/16 PB
7,661,633 B2 * 2/2010 Igarashi ..... F16L 3/2334 248/62
9,021,681 B2 * 5/2015 Owen ..... B65D 63/1027 29/525.01
9,339,100 B2 * 5/2016 Moreau ..... A45F 5/00
2010/0236030 A1 * 9/2010 Dyer ..... F16L 55/02 24/16 PB
2012/0041441 A1 2/2012 Bernstein et al.
2019/0218006 A1 * 7/2019 Matz ..... B65D 63/1072
2021/0024264 A1 * 1/2021 Beyer ..... B65D 63/1063

* cited by examiner

LOAD-RATED TOOL TETHER

FIELD OF THE INVENTION

This invention relates generally to a load rated tool tether for attachment to various types of tools for lanyard securement in use for drop prevention.

BACKGROUND OF THE INVENTION

Various ways of safely tethering tools exist including GB 2353752 A (LEWIS, VERNON et al.) 7 Mar. 2001 [hereinafter referred to as D1] which discloses a lanyard retractable from a wrist cassette which attaches to a tool thereof by way of a Velcro™ strap.

However, the configuration of D1 is not adequately load rated, especially for heavier tools such as electric power tools.

U.S. Pat. No. 5,082,156 A (BRAUN) 21 January [hereinafter referred to as D2] discloses a configuration having a more resilient wrist strap from which a loop is connected at a proximal end thereof for engaging a tool at a distal end thereof. A clench bead slides towards the proximal end to tighten around the tool engage therein.

However, the loop and clench bead of D2 is also not adequately load rated. Furthermore, tools, especially elongate tools, may inadvertently slip from the clench bead engagement when dropped.

Whereas other configurations exist in unrelated fields, including JP 2017-136238 A (DAIICHI VINYL K K) 10 Aug. 2017 [hereinafter referred to as D3] which discloses a carry handle for a shopping bag and US 2012/0041441 A1 (BERNSTEIN et al.) 16 Feb. 2012 [hereinafter referred to as D4] from the medical field which discloses a cable tie system for stabilising bone, tethers for tools are currently deficient in several respects.

The present invention seeks to provide a load rated tool tether, which will overcome or substantially ameliorate at least some of the deficiencies of the prior art, or to at least provide an alternative.

SUMMARY OF THE DISCLOSURE

There is provided herein a load rated tool tether for attachment to a tool for securement with a lanyard as is shown in FIG. 2.

The present tether has a particular configuration for enhanced load rating. The present tether has been designed so as to be, for example, able to catch a 2.5 kg tool drop from a height of up to 1.3 m in accordance with an embodiment.

Specifically, the present load rated tool tether comprises a gate and a serrated surface strap integrally formed with the gate and extending from the gate. The gate has a channel therethrough between an entrance and exit and a locking tang operably interfacing the channel between the entrance and the exit for feeding in and one-way non-releasable engagement of the strap therethrough in use.

Furthermore, the tether has a securement ring integrally formed with the gate and extending from the gate between the entrance and the exit and at an angle with respect to a longitudinal axis of the channel.

Dissimilarly, D1 and D2 discloses no such device for attachment to a tool, let alone one having a gate and integrally formed securement ring and strap extending therefrom. As is evident from the current state of development of the tool securement prior art, current arrangements have rudimentary non-load rated tool attachments such as clench beads and Velcro™ straps.

Furthermore, D3, from the unrelated field of carrying shopping bags and the like, fails to disclose an integrally formed securement ring, other than a mushroom head engaging swivel type handle which is non-load rated. This configuration of D3 is desirous for preventing twisting of shopping bags when carrying but there is no evident motivation for the integral formation of a securement ring as like the present invention.

Furthermore, D4, yet also from an unrelated medical field similarly fails to disclose an integrally formed securement ring, other than a pivotally attached releasable pull handle. The pull handle of D4 is desirous for tightening the buckle while pulling the strap oppositely in alignment for tightening around bone but not for attachment thereto. As such, D4 furthermore fails to disclose the securement ring of the present tether which is integrally connected to a gate between an entrance and exit thereof and which is at an angle with respect to a channel therethrough.

In embodiments, the present securement ring may comprise an outer profile which intersects a surface of the gate, such that the securement ring and the gate are robustly integrally connected for enhanced load rating.

The present tether is further characterised in light of the prior art in that the strap and the gate transition at an integral connection edge at a connection angle with respect to the longitudinal axis of the channel.

Furthermore, the entrance is spaced away from the integral connection edge so as to expose an undersurface of the gate. The undersurface may have a width between the integral connection edge and the entrance by more than 5 mm, such as greater than 10 mm as shown in FIG. 10.

As such, in use, when the strap is tightened around the tool, the securement ring is held firm by being integrally connected to the gate and wherein the gate is firmly held from either side thereof by the strap by the spaced apart configuration, thereby reducing twisting of the gate or bending of the securement ring with respect to the tool, especially when the distal end of the securement ring is jerked, thereby enhancing the securement of the tether to the tool. Especially where the securement ring lies orthogonally with respect to the channel (i.e. in that the securement ring lies on a securement ring plane perpendicular with respect to the longitudinal axis of the channel), force is applied thereto may act in direct alignment with the strap holding the gate other side thereof, further enhancing load rating jerk resistance.

Furthermore, the spaced apart connection of the straps either side of the gate allow the gate to take greater tension. Furthermore, the undersurface of the gate may frictionally bear against the tool retained therein, thereby reducing slippage of the tool from the tether when dropped.

In embodiments the undersurface may be planar and each adjacent portion of the strap may meet the gate orthogonally at substantially 90° with respect to each other and each at an angle of approximately 45° with respect to the undersurface, thereby allowing a central contact point of the undersurface to extend towards and frictionally engage the tool.

Dissimilarly, the configuration of D3 shows no such spaced apart configuration and the handle and gate body thereof would likely bend with respect to the object retained therein and break.

Furthermore, D4 does not show a securement ring integrally connected with a gate, let alone at an angle with respect to a channel thereof. Furthermore, the strap of D4 does not interface the gate at a connection angle with respect to the channel.

In embodiments, the tool comprises a frictional engagement member, such as of rubber, which interfaces between the undersurface of the gate and the tool retained within the tether. The frictional engagement member may comprise a friction pad comprising side loops which releasably seat within edge channels of the gate. The friction pad may comprise a planar rearward surface which interfaces flush with the corresponding planar undersurface of the gate. However, the inner face of the friction pad may be substantially cylindrical so as to engage around cylindrical objects such as tool handles.

The friction pad may comprise edges which extend beyond the undersurface in alignment with the strap so as to enhance the frictional engagement either side of the undersurface. Furthermore, the edges may bend to conform with the profile of the tool and may even lie substantially flat when pressed against a tool of relatively large diameter.

According to one aspect, there is provided, a load-rated tool tether comprising a gate and a serrated surface strap integrally formed with the gate and extending from the gate, the gate having a channel therethrough between an entrance and an exit and a locking tang operably interfacing the channel between the entrance and the exit for the feed in and one-way non-releasable engagement of the strap therethrough in use, wherein the strap and the gate transition at an integral connection edge at a connection angle with respect to a longitudinal axis of the channel and wherein the gate has a dimension such that the entrance thereof is spaced away from the integral connection edge so as to expose an undersurface of the gate between the integral connection edge and wherein the tether further comprises a securement ring integrally formed with the gate and extending from between the entrance and the connection edge of the gate at an angle with respect to the longitudinal axis of the channel, such that, in use, when the strap is tightened around a tool, the securement ring is resiliently held by the integrally formed gate secured either side thereof by the strap between the integral connection edge and the entrance in a spaced apart configuration and the undersurface bears tangentially against the tool.

The securement ring may lie on a securement ring plane perpendicular with respect to the longitudinal axis of the channel.

The undersurface may have a dimension between the integral connection edge and the entrance of greater than 5 mm.

The undersurface may have a dimension between the integral connection edge and the entrance of greater than 10 mm.

The undersurface may be planar.

The tang may have a width of greater than 5 mm.

The tang may be deflectably connected from a live hinge adjacent the entrance.

The longitudinal axis may be orthogonal with respect to the connection angle.

The securement ring may lie on a securement ring plane and the plane may be in alignment with the connection angle.

The securement ring may be annular.

The securement ring may comprise an outer cross-section profile and the outer cross-section profile intersects a surface of the gate.

The securement ring may comprise an inner cross-section profile and the inner section profile meets the surface of the gate tangentially.

The securement ring may comprise a thickness of greater than 3 mm.

The strap may comprise an aperture therethrough.

The strap may comprise a distal connection formation configured for connection with the aperture.

The tether may further comprise a frictional engagement member against the undersurface.

The frictional engagement member may comprise a friction pad having integrally formed loops at edges thereof which connect about the gate.

The gate may comprise side channels configured for seating the lives respectively therein.

The friction pad may comprise a planar rear surface.

The friction pad may comprise a curved front surface.

The curved front surface may be semicylindrical about a transverse axis.

The friction pad may have a dimension greater than a dimension of the undersurface such that edges thereof extend beyond the undersurface under adjacent portions of the strap.

According to another aspect, there is provided a method of tool securement using the load rated tool tether of claim 1, the method comprising inserting a portion of the tool with the strap and inserting the strap through the entrance of the channel and out from the extent thereof and tightening the strap about the tool such that the strap interfaces the gate either side of thereof in a spaced apart configuration and an underside thereof bears tangentially against the tool.

Other aspects of the invention are also disclosed.

BRIEF DESCRIPTION OF THE DRAWINGS

Notwithstanding any other forms which may fall within the scope of the present invention, preferred embodiments of the disclosure will now be described, by way of example only, with reference to the accompanying drawings in which.

DESCRIPTION OF EMBODIMENTS

A load rated tool tether 100 comprises a gate 101, a securement ring 102 integrally formed therewith and extending from the gate 101. The tether 100 further comprises a serrated surface strap 103 integrally formed with the gate 101 and extending from the gate 101.

Figure 3:
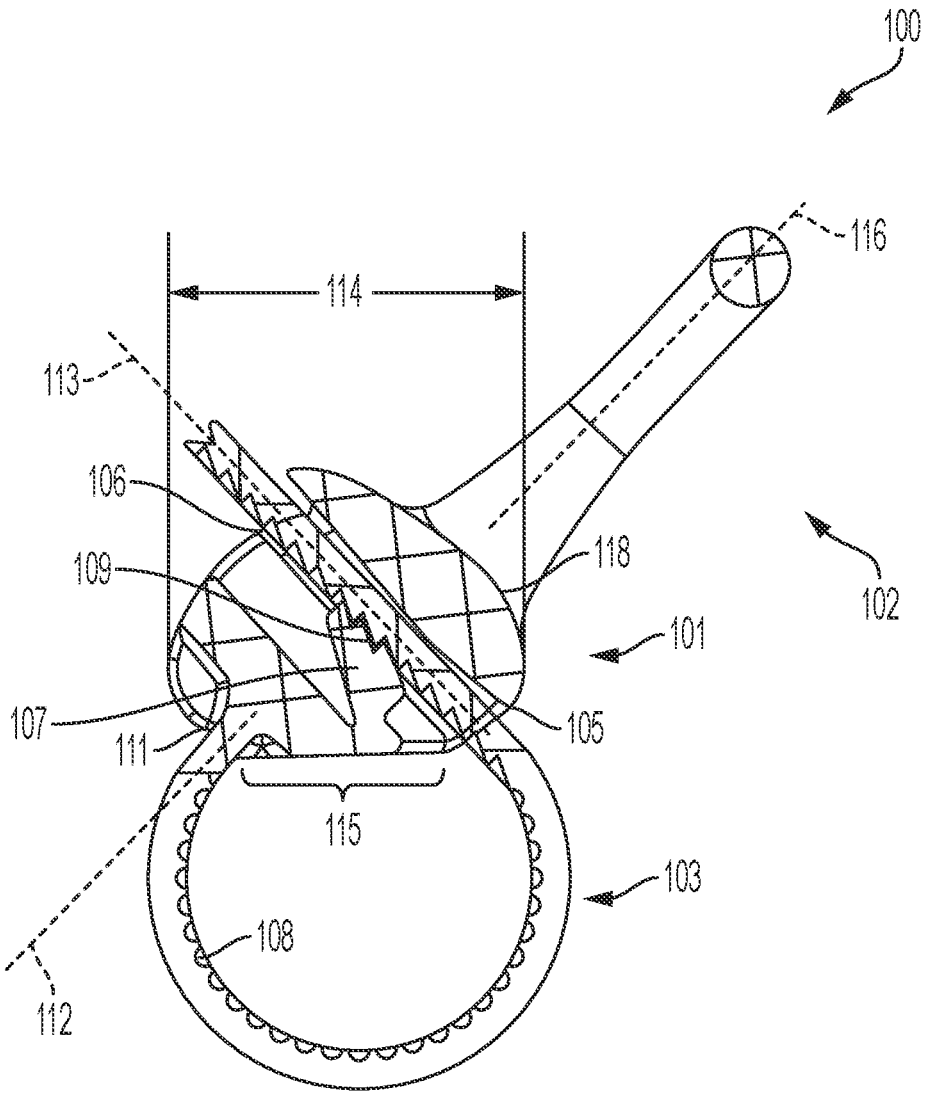
FIG. 3 shows a cross-sectional view of the tether with a strap thereof fed therethrough in one-way nonreleasable engagement.

The gate 101 has a channel 104 therethrough between an entrance 105 and exit 106 and a locking tang 107 operably interfacing the channel 104 between the entrance 105 and the exit for the feed in and one-way non-releasable engagement of the strap 103 therethrough in use in the manner shown in FIG. 3.

Figure 1:
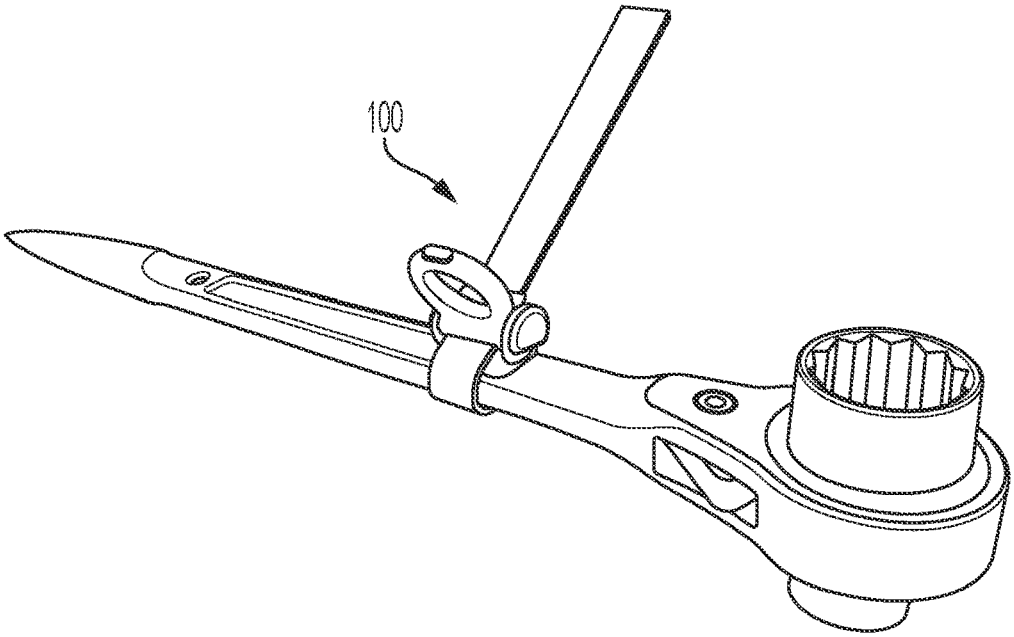
FIG. 1 illustrates a load rated tool tether fastened to a wrench.
Figure 2:
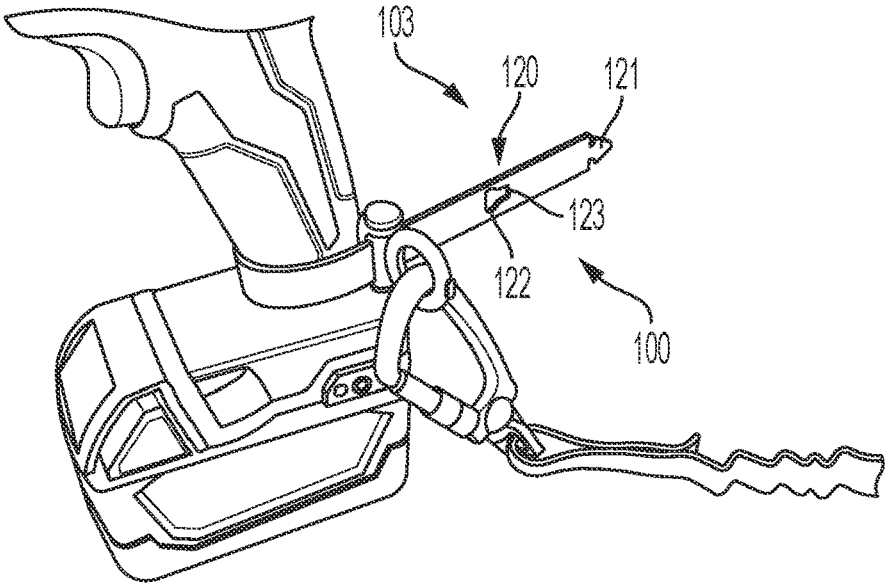
FIG. 2 illustrates the load rated tool tether fastened to a power drill and secured by a carabiner and lanyard therethrough.

The tether 101 is designed for secure attachment the various tools, such as the wrench as shown in FIG. 1 or the power drill shown in FIG. 2.

Figure 5:
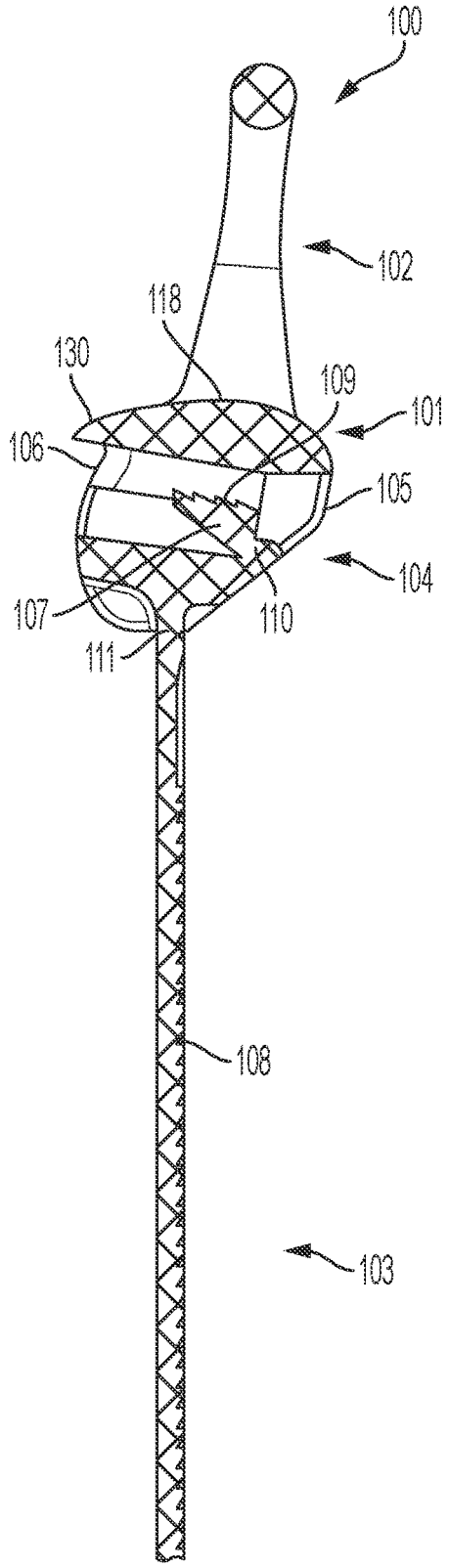
FIG. 5 shows a cross-sectional view of the proximal end of the tether.

The strap 103 may comprise serrations 108 at an inner surface thereof which catch against corresponding serrations 109 of the tang 107. As is shown in FIG. 5, the tang 107 may be integrally formed and pivotable about a live hinge 110 so as to interfere with the channel 104 yet be deflectable as the strap 103 passes from the entrance 105 to the exit 106. As is best seen in FIG. 5, the channel 104 may narrow slightly at the tang 107. The exit 106 may comprise an overhang 130 which may guide the strap 103 therefrom.

With reference to FIG. 3, the strap 103 and the gate 101 transition at an integral connection edge 111 at an angle 112 with respect to a longitudinal axis 113 of the channel 104.

Figure 10:
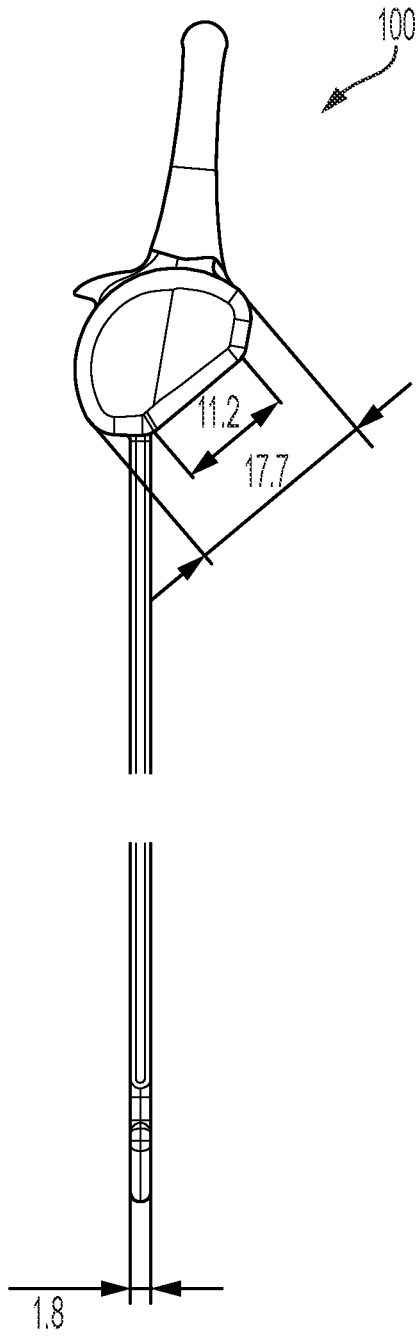
FIG. 10 shows a side view of the tether with exemplary dimensions in accordance with an embodiment

The gate 101 has a tangential dimension 114 (i.e. between the entrance 105 and the connection edge 111) such that the entrance 105 is spaced away from the integral connection edge 111 so as to expose an undersurface 115 of the gate 101. The tangential dimension 114 may, for example, be between 15 and 20 mm. With reference to an embodiment shown in FIG. 10, the tangential dimension may be approximately 17 mm.

The undersurface 115 may comprise a tangential dimension of greater than 5 mm. According to the embodiments of FIG. 10, the undersurface may comprise a tangential of greater than 10 mm such as approximately 11 mm as shown.

As such, when the strap 103 is tightened around a tool in use in the manner shown in FIG. 1 or 2, the strap 103 interfaces the gate 101 in a spaced apart configuration between the integral connection edge 111 and the entrance 105 and the undersurface bears tangentially against the tool.

With reference to FIG. 3, the securement ring 102 may lie on a plane 116 and the connection angle 112 may be substantially tangential with the plane 116.

Furthermore, the longitudinal axis 113 of the channel 104 may be substantially orthogonal with the connection angle 112 and the plane 116.

Figure 4:
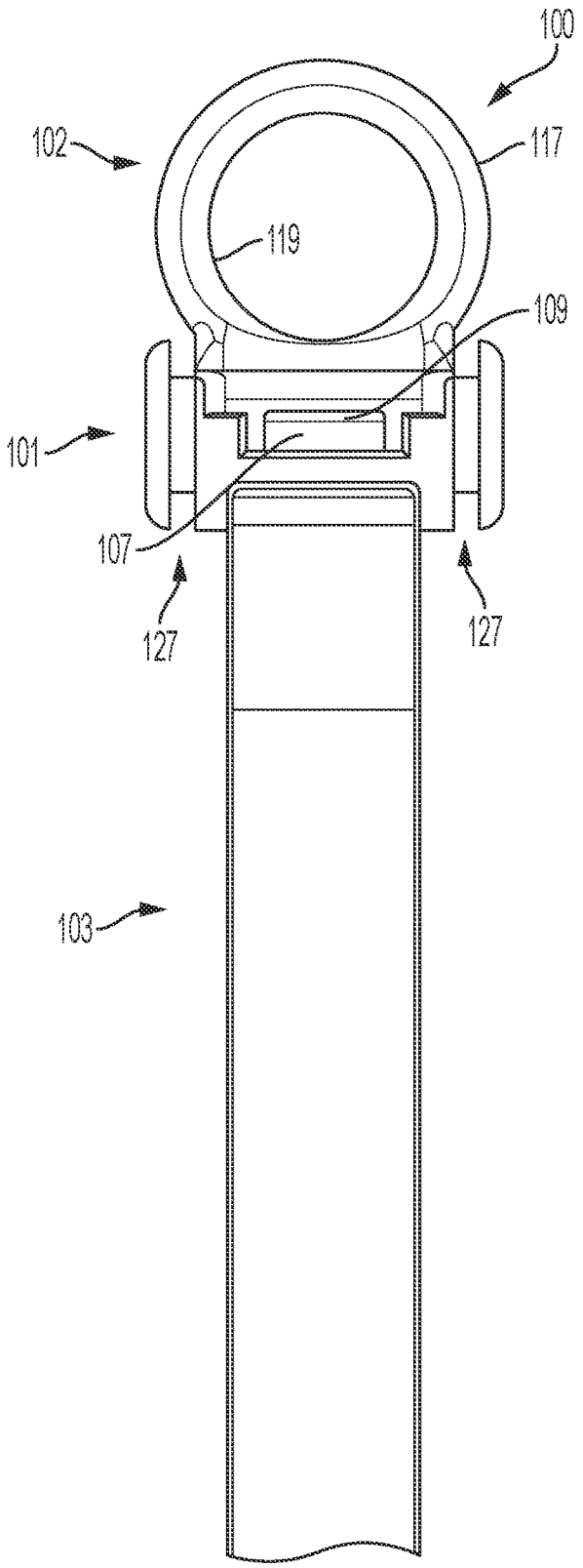
FIG. 4 shows a top plan view of a proximal end of the tether.

With reference to FIG. 4, the securement ring may be substantially annular. With reference to FIG. 4, the securement ring 102 may have an outer cross-section 117 which intersects an upper surface 118 of the gate 104. Furthermore, the securement ring 102 may comprise an inner cross-section profile 119 which similarly intersects the upper surface 118 or meets the upper surface 118 tangentially as is shown in FIG. 4.

Figure 8:
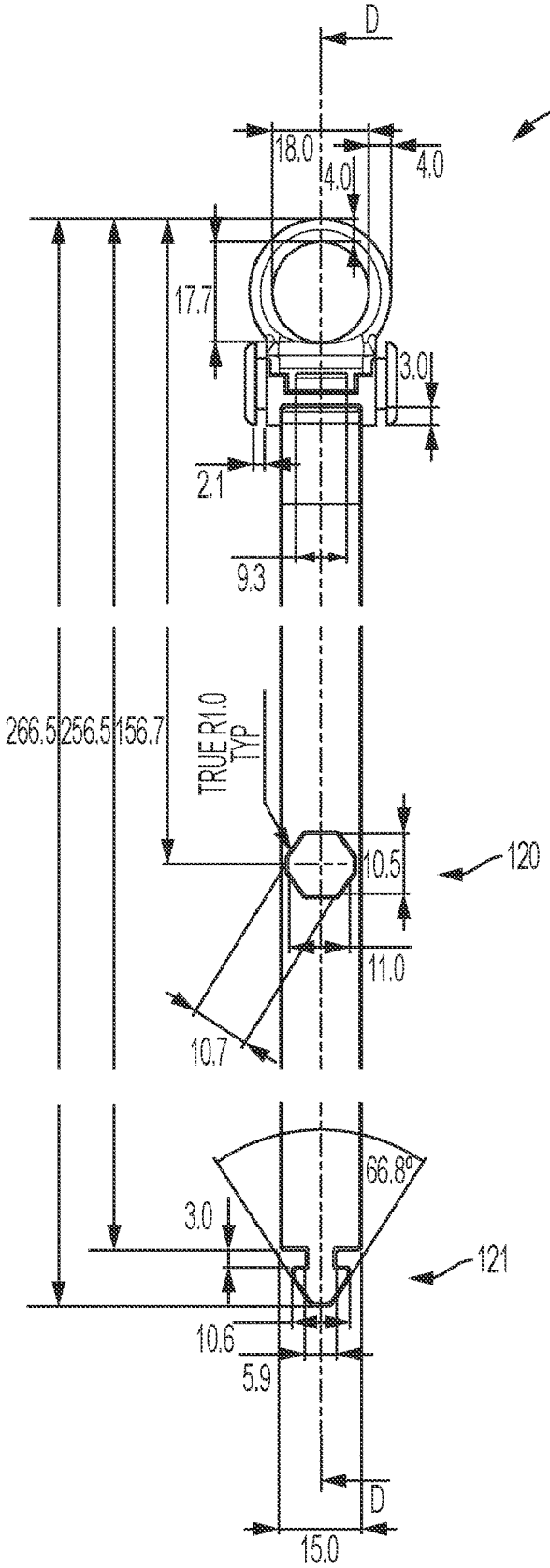
FIG. 8 shows a top plan view of the tether with exemplary dimensions in accordance with an embodiment.
Figure 9:
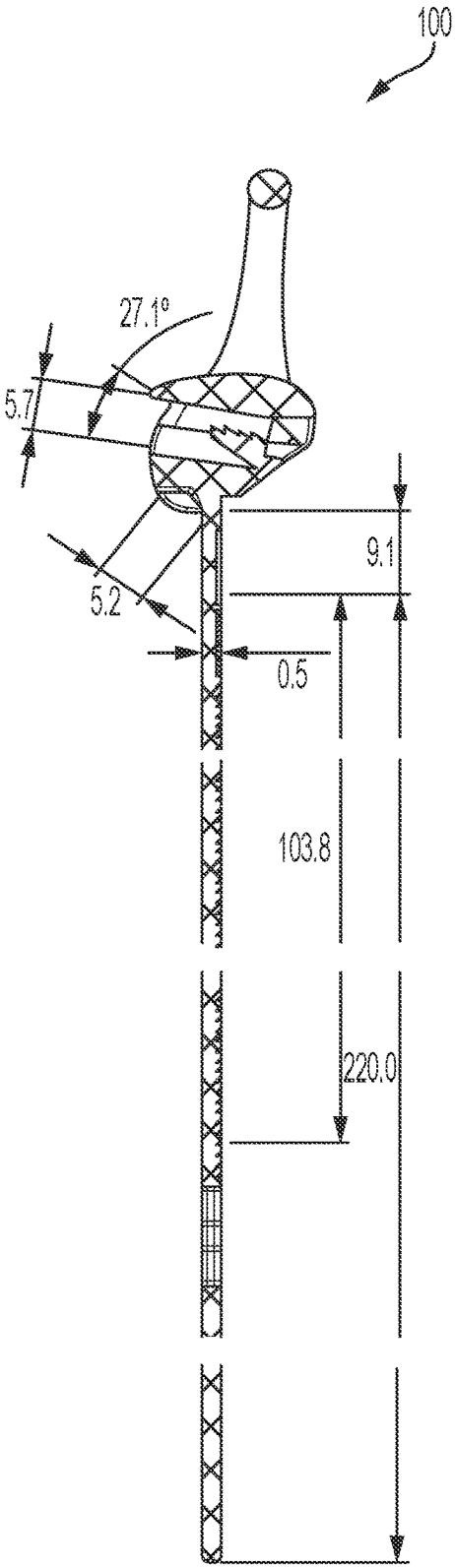
FIG. 9 shows a side cross-sectional view of the tether with exemplary dimensions in accordance with an embodiment.

The securement ring 103 may comprise a cross-sectional width of greater than 3 mm or approximately 4 mm as shown in FIG. 8. The securement ring 102 may comprise an inner diameter of greater than 15 mm or approximately 18 mm as shown in FIG. 8.

Furthermore, the strap 103 may comprise a width of greater than 10 mm, such as approximately 15 mm as shown in FIG. 8 and the tang 107 may comprise a width of greater than 5 mm such as approximately 9 mm as shown in FIG. 8.

In embodiments, the strap 103 may comprise an aperture 120 as shown in FIG. 8. In use, a tool such as a screwdriver may be engaged therethrough to apply leverage to tighten the strap. When sufficient force is applied, the strap 103 may break apart at the break apart aperture 120 leaving a stub conveniently shortened without cutting using scissors or knives.

In embodiments, the distal end of the strap 103 may comprise an arrowhead formation 121 which may engage within the aperture 124 forming a loop within the strap 103 at a distal end thereof.

With reference to the embodiment shown in FIG. 2, the aperture 120 may comprise a widened portion 121 towards a proximal end of the strap 103 which may fit the width of the arrowhead 121 therethrough and a narrow portion 123 towards a distal end thereof which accommodates the neck of the arrowhead 121 therethrough but which is narrower than the width of the arrowhead 121.

With reference to FIG. 3, the connection angle 112 and the longitudinal axis 113 of the channel 104 may be substantially orthogonal such that adjacent sides of the strap 103 engage the gate 101 in a spaced apart configuration at an angle of approximately 90° therebetween.

In the embodiments shown in FIG. 3, the undersurface 115 may be planar and may be angled at approximately 45° with respect to the connection angle 112 and the channel axis 113.

Figure 6:
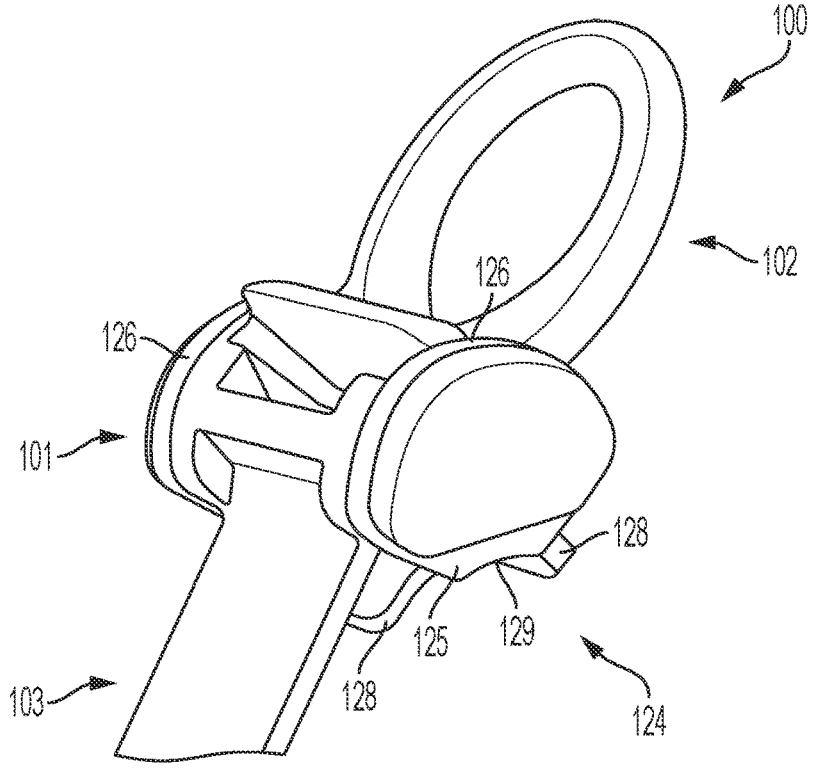
FIG. 6 shows a top perspective view of the proximal end of the tether.
Figure 7:
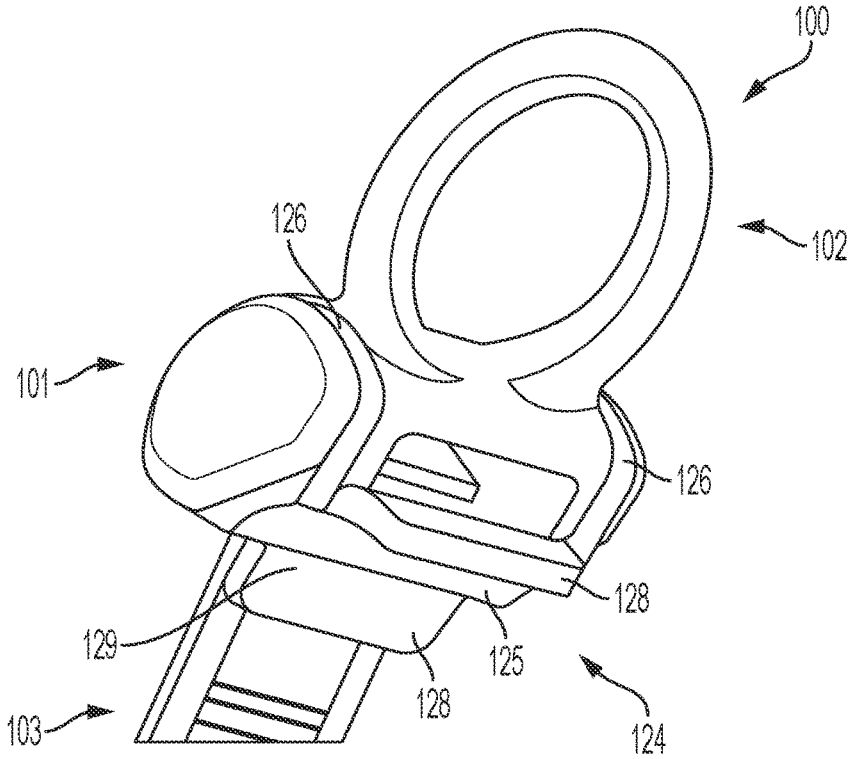
FIG. 7 shows a bottom perspective view of the proximal end of the tether.

With reference to FIGS. 6 and 7, there is shown an embodiment wherein the tether 101 comprises a frictional interface member 124 which may comprise a friction pad 125 which frictionally interfaces between the undersurface 115 and the tool engage therein. Sides of the pad 105 may be retained by loops 126 that run through accommodating side channels 127 of the gate 101 as is more clearly shown in FIG. 4.

The friction pad 125 may comprise a planar rear surface so as to lie flush against the undersurface 115 of the gate 101. The friction pad 125 may comprise a curved face 129 being semicylindrical along a widthwise axis of the gate 101.

The friction pad 125 may comprise edges 128 which extend beyond the undersurface 115 so as to lie flat and increase the contact area against tool portions of larger diameters.

The foregoing description, for purposes of explanation, used specific nomenclature to provide a thorough understanding of the invention. However, it will be apparent to one skilled in the art that specific details are not required in order to practise the invention. Thus, the foregoing descriptions of specific embodiments of the invention are presented for purposes of illustration and description. They are not intended to be exhaustive or to limit the invention to the precise forms disclosed as obviously many modifications and variations are possible in view of the above teachings. The embodiments were chosen and described in order to best explain the principles of the invention and its practical applications, thereby enabling others skilled in the art to best utilize the invention and various embodiments with various modifications as are suited to the particular use contemplated. It is intended that the following claims and their equivalents define the scope of the invention.

The invention claimed is:

1. A load-rated tool tether comprising a gate and a serrated surface strap integrally formed with the gate and extending from the gate, the gate having a channel therethrough between an entrance and an exit and a locking tang operably interfacing the channel between the entrance and the exit for the feed in and one-way non-releasable engagement of the strap therethrough in use, wherein the strap and the gate transition at an integral connection edge at an connection angle with respect to a longitudinal axis of the channel and wherein the gate has a dimension such that the entrance thereof is spaced away from the integral connection edge so as to define an undersurface of the gate between the integral connection edge and the entrance, and wherein the tether further comprises a securement ring integrally formed with the gate and extending from the gate, in a direction away from the undersurface, between the entrance and the exit of the gate at an angle with respect to the longitudinal axis of the channel, such that, in use, when the strap is tightened around a tool, the securement ring is resiliently held by the integrally formed gate secured either side thereof by the strap between the integral connection edge and the entrance in a spaced apart configuration and the undersurface bears tangentially against the tool, wherein the load-rated tool tether further comprises a frictional engagement member against the undersurface, and wherein the frictional engagement member comprises a friction pad having integrally formed loops at edges thereof which connect about the gate.

2. A load-rated tool tether as claimed in claim 1, wherein the gate comprises side channels configured for seating the loops respectively therein.

* * * * *